US007713184B2

(12) United States Patent
Scott et al.

(10) Patent No.: US 7,713,184 B2
(45) Date of Patent: May 11, 2010

(54) VERTICAL FILTER FILLING MACHINE AND PROCESS

(75) Inventors: George R. Scott, Midlothian, VA (US); Martin T. Garthaffner, Chesterfield, VA (US); Steven F. Spiers, Richmond, VA (US); Steven R. Rinehart, Chesterfield, VA (US); Barry S. Smith, Hopewell, VA (US); James D. Evans, Chesterfield, VA (US)

(73) Assignee: Philip Morris USA Inc., Richmond, VA (US)

( * ) Notice: Subject to any disclaimer, the term of this patent is extended or adjusted under 35 U.S.C. 154(b) by 0 days.

(21) Appl. No.: 12/341,051

(22) Filed: Dec. 22, 2008

(65) Prior Publication Data

US 2009/0118109 A1 May 7, 2009

Related U.S. Application Data

(62) Division of application No. 11/268,291, filed on Nov. 4, 2005, now Pat. No. 7,479,099.

(60) Provisional application No. 60/625,747, filed on Nov. 5, 2004.

(51) Int. Cl.
*B31V 99/00* (2006.01)

(52) U.S. Cl. ..... 493/47; 493/39; 493/50

(58) Field of Classification Search ..... 493/47, 493/39, 45, 48, 44, 50
See application file for complete search history.

(56) References Cited

U.S. PATENT DOCUMENTS

| | | | |
|---|---|---|---|
| 3,122,974 | A | 3/1964 | Rowlands |
| 3,199,418 | A | 8/1965 | Schubert |
| 3,517,480 | A | 6/1970 | Pinkham |
| 3,547,009 | A | 12/1970 | Molins |
| 3,566,753 | A | 3/1971 | Mantke |
| 3,603,058 | A | 9/1971 | Schubert et al. |
| 4,036,119 | A | 7/1977 | Schubert et al. |
| 2002/0119874 | A1 | 8/2002 | Heitmann et al. |
| 2002/0153017 | A1 | 10/2002 | Georgitsis et al. |
| 2008/0078416 | A1 | 4/2008 | Evans et al. |

FOREIGN PATENT DOCUMENTS

| | | |
|---|---|---|
| EP | 1 226 765 A2 | 7/2002 |
| GB | 1 243 977 | 8/1971 |
| WO | WO-2005/102080 | 11/2005 |

*Primary Examiner*—Sameh H. Tawfik
(74) *Attorney, Agent, or Firm*—Connolly Bove Lodge & Hutz LLP

(57) ABSTRACT

Process and apparatus for the mass production of compound cigarette filters function to deposit granular filter material into the open ends of vertically oriented filter tubes. Predetermined amounts of diverse granular material are withdrawn by suction from sources of such material, and these amounts are deposited into the tubes. Solid filter segments seal the granular material within the tube. After one half of each filter tube is filled with granular material and sealed, the tube is inverted and the opposite end is filled in substantially the same manner. When cut in half each filter tube produces two cigarette filters.

12 Claims, 10 Drawing Sheets

Vacuum 10
12,14
40
42
38
34
30
26
36
32
28
18
58
56
44
54
50
14
46
52
48
60
70
20
24
22
16

Vacuum
10
12,14
40
42
38
36
34
32
30
28
26
18
58
44
52
48
46
14
16
70
60
20
24
22

Vacuum
10
12,14
40
42
38
36
34
32
30
28
26
18
58
56
44
54
52
46
48
14
16
70
60
20
24
22

Vacuum
10
12,14
40
42
38
36
34
32
30
28
26
18
58
56
44
54
50
46
52
48
14
16
70
60
20
24
22

Vacuum

Vacuum Air Pulse

Vacuum
10
12,14
16
18
20
22
24
26
32
34
36
38
40
42
44
46
48
51
52
54
56
57
58
60
66

Vacuum
10
12,14
40
38
42
36
18
44
52
48
60
20
24
22
70
14
16

Vacuum
10
12,14
40
38
42
36
26
18
44
54
58
52
48
60
20
14
16

Vacuum
10
12,14
40
38
36
26
18
44
58
52
60
24
20
22
14
16

Air Pulse (If Req)

Vacuum
10
12,14
40
42
36
38
18
44
58
48
52
14
16
26
20
60
24
22
70

10
12,14
40
42
38
36
26
18
58
44
52
48
60
20
24
22
16
14

VERTICAL FILTER FILLING MACHINE AND PROCESS

CROSS REFERENCE RELATED TO APPLICATION

The present application is a division of application Ser. No. 11/268,291 filed Nov. 4, 2005, now U.S. Pat. No. 7,479,009. Application Ser. No. 11/268,291 claims the benefit of provisional application Ser. No. 60/625,747, filed Nov. 5, 2004, for all useful purposes, and the specification and drawings thereof are included herein by reference.

BACKGROUND OF THE INVENTION

U.S. Pat. Nos. 3,517,480 and 3,603,058 illustrate and describe machines for the production of composite cigarette filters by directly flowing granular filter material from a storage hopper into a vertically oriented filter tube made of paper. Similarly, US Patent Application Publication 2002/0119874A1 describes another machine for producing compound cigarette filters that includes a series of rotating plates with cavities therein into which the granular filter material is deposited. The cavities ultimately are aligned with an open paper ended filter tube to facilitate deposit of the granular material into the tube. These machines have the disadvantage of often destroying the integrity of the paper filter tubes into which filter materials are deposited. They also deposit imprecise amounts of granular material and produce undesired amounts of fine dust and the like.

SUMMARY OF THE INVENTION

Accordingly, one of the objects of the present invention is a vertical filter filling machine and process for producing multiple cavity cigarette filters in a highly efficient and economical manner at high rates of production.

Another object of the present invention is a vertical filter filling machine and process having the ability to assemble very small filter components less than three millimeters in length.

Another object of the present invention is a vertical filter filling machine and process for producing multiple cavity cigarette filters which includes precise dosing of reduced smoking constituent materials and/or flavoring materials.

Still another object of the present invention is a vertical filter filling machine and process for producing compound cigarette filters with minimal or no cross contamination of filter material whereby extremely clean filters are produced.

Another object of the present invention is a vertical filter filling machine and process for producing compound cigarette filters with precise dosing of granular material while eliminating granular material scatter on the filters being produced at extremely high production rates.

Another important object of the present invention is maintaining the integrity of the paper filter tubes when filling the tubes with granular materials and discrete solid filter segments.

In accordance with the present invention a preformed filter tube of paper with hollow ends and a solid center of cellulose acetate or similar material is formed into two multiple cavity cigarette filters. The filter tube is vertically oriented and moves along a generally circular path where metered amounts of granular filter material are precisely deposited in the tubes after which a plug of cellulose acetate or similar material is placed in the tube to thereby seal the granular material. A second deposit of different granular material may also be placed in the tube as well as a second plug to seal that material. Subsequently, the tube is inverted and the remaining half is filled with granular material and sealed in the same manner. Cutting the tube midway through the solid center thereof produces two individual multiple cavity cigarette filters.

Specifically, the process of producing compound cigarette filters according to the present invention comprises the steps of placing a filter tube with hollow ends and a solid filter center in a substantially vertical position. A predetermined amount of granular material is withdrawn by suction from a source of such material, and the predetermined amount of material is deposited into an upper open end of the filter tube directly against the solid center. Next, a solid filter segment is placed into the upper open end of the filter tube directly against the granular material to thereby seal the material in place.

Throughout the entire filling process, the integrity of filter tube, usually made of thin easily crumpled paper, is maintained by initially depositing the filter materials into an internal alignment tube placed within the filter tube and then pushing the filter materials directly into the filter tube without any significant relative movement between the filter materials and the interior walls of the filter tube. Moreover, as the solid filter segment exits the internal alignment tube into the filter tube, the filter tube moves in a downward direction at a speed that matches the downward speed of the segment. This coordinated movement prevents sliding of the segment against the inside surface of the filter tube which might otherwise cause the filter tube to wrinkle or buckle.

Additionally, a predetermined amount of a second granular material may be deposited into the upper open end of the filter tube directly against the solid filter segment already in place. A second solid filter segment may then be placed into the upper open end of the filter tube directly against the second granular material to thereby seal the second material in place.

The process of the present invention also includes inverting the filter tube and filling the other end of the tube with granular material and solid filter segments in the same manner as the first end.

Moreover, the solid filter segments placed against the granular material may be produced from an extended solid filter segment which is sliced into two pieces during the process to thereby produce each of the two solid filter segments. Both the solid filter center and solid filter segments may comprise cellulose acetate tow.

In accordance with the present invention, apparatus for producing compound cigarette filters comprises a rotating tube flute plate for holding and transporting a plurality of filter tubes along a circular path. Each filter tube has opposite hollow ends and a solid filter center, and the tubes are held by suction in vertically orientation flutes on the tube flute plate. A plurality of vertically orientated fill tubes with suction applied thereto withdraw predetermined amounts of granular material from a rotating bin of such material and deposit one predetermined amount into the upper open end of each filter tube directly against the solid filter center upon termination of the suction on the fill tubes. A rotating segment plate holds a plurality of solid filter segments, and a plurality of rotating plungers vertically push the solid filter segments out of the plate into the upper open ends of the filter tubes directly against the granular material in each filter tube to thereby seal the material in the tube.

The integrity of the filter tube is maintained throughout the filling process by initially placing the filter materials into an internal alignment tube and then pushing those materials out of the alignment tube after the filter tube is placed over the alignment tube, and in doing so using the aforementioned coordinated movement to avoid relative motion between the materials being pushed and the paper tube which receives the pushed material.

Preferably, a second plurality of vertically oriented fill tubes with suction applied thereto withdraw predetermined amounts of a second granular material from the rotating bin. One predetermined amount of the second granular material is deposited into the open upper end of each filter tube directly against the solid filter segment already in place upon termination of the suction on the second fill tubes. A rotating second segment filter plate holds a plurality of second solid filter segments and the plurality of plungers vertically push the second solid filter segments out of the second filter segment plate into the upper open ends of the filter tubes directly against the second granular material in each filter tube to thereby seal the second material in the tubes.

The rotating bin of granular material preferably includes several compartments with each compartment containing a different granular material.

In the preferred embodiment of the present invention, the rotating tube flute plate, the rotating bin of granular material, the plurality of vertically orientated fill tubes and second fill tubes, the rotating filter segment plate and second filter segment plate, and the plurality of rotating plungers collectively comprise an upper wheel assembly rotating about a central vertical axis. A substantially identical lower wheel assembly also rotates about the same central vertical axis. A conveyor system removes half filled filter tubes from the upper wheel assembly, inverts the tubes and places them on the rotating tube flute plate of the lower wheel assembly. The other ends of the filter tubes are then filled with granular material and solid filter segments on the lower wheel assembly.

In the apparatus of the present invention a segment flute plate holds a plurality of extended length solid filter segments. A rotating cutter moveable between the solid filter segment plate and the second solid filter segment plate cuts the extended length solid filter segment after positioning thereof in the solid segment plate and the second solid segment plate to thereby form the solid filter segments and the second solid filter segments.

In accordance with the present invention, the multiple cavity dual filters may be removed and directly delivered to a tipping machine where wrapped tobacco rods at both ends of the filter are attached with tipping paper. Cutting the filter in half produces two cigarettes. This arrangement eliminates the need to store and deliver the dual filters to a distant tipping machine.

BRIEF DESCRIPTION OF THE DRAWINGS

Novel features and advantages of the present invention in addition to those noted above will be become apparent to persons of ordinary skill in the art from a reading of the following detailed description in conjunction with the accompanying drawings wherein similar reference characters refer to similar parts and in which.

DETAILED DESCRIPTION OF THE INVENTION

Figure 1:
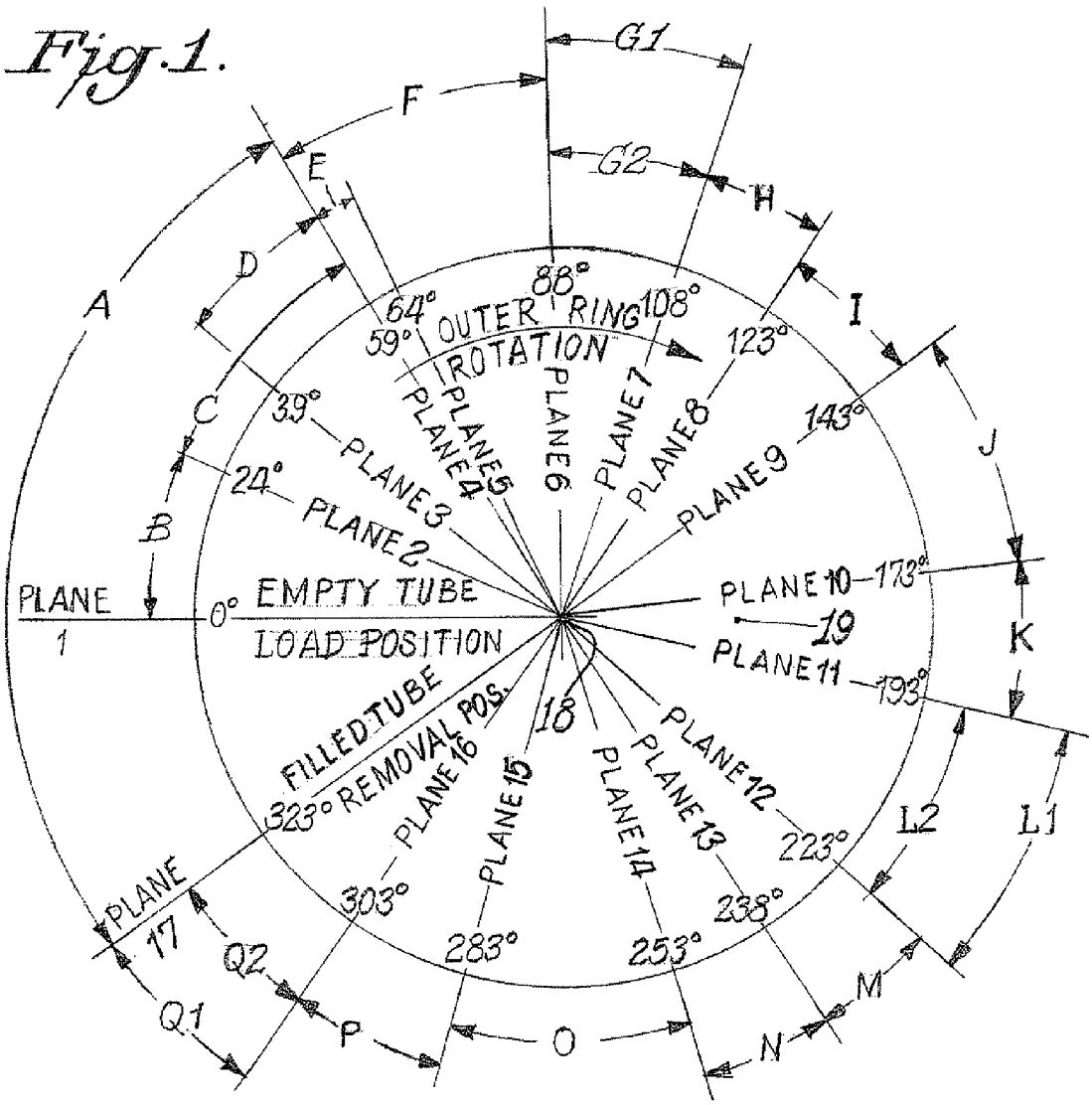
FIG. 1 is a diagrammatic top plan view of a vertical filter filling machine illustrating the various angular locations of sequential filter filling process planes 1-17 as the machine rotates one full revolution or cycle, according to the present invention.
Figure 20:
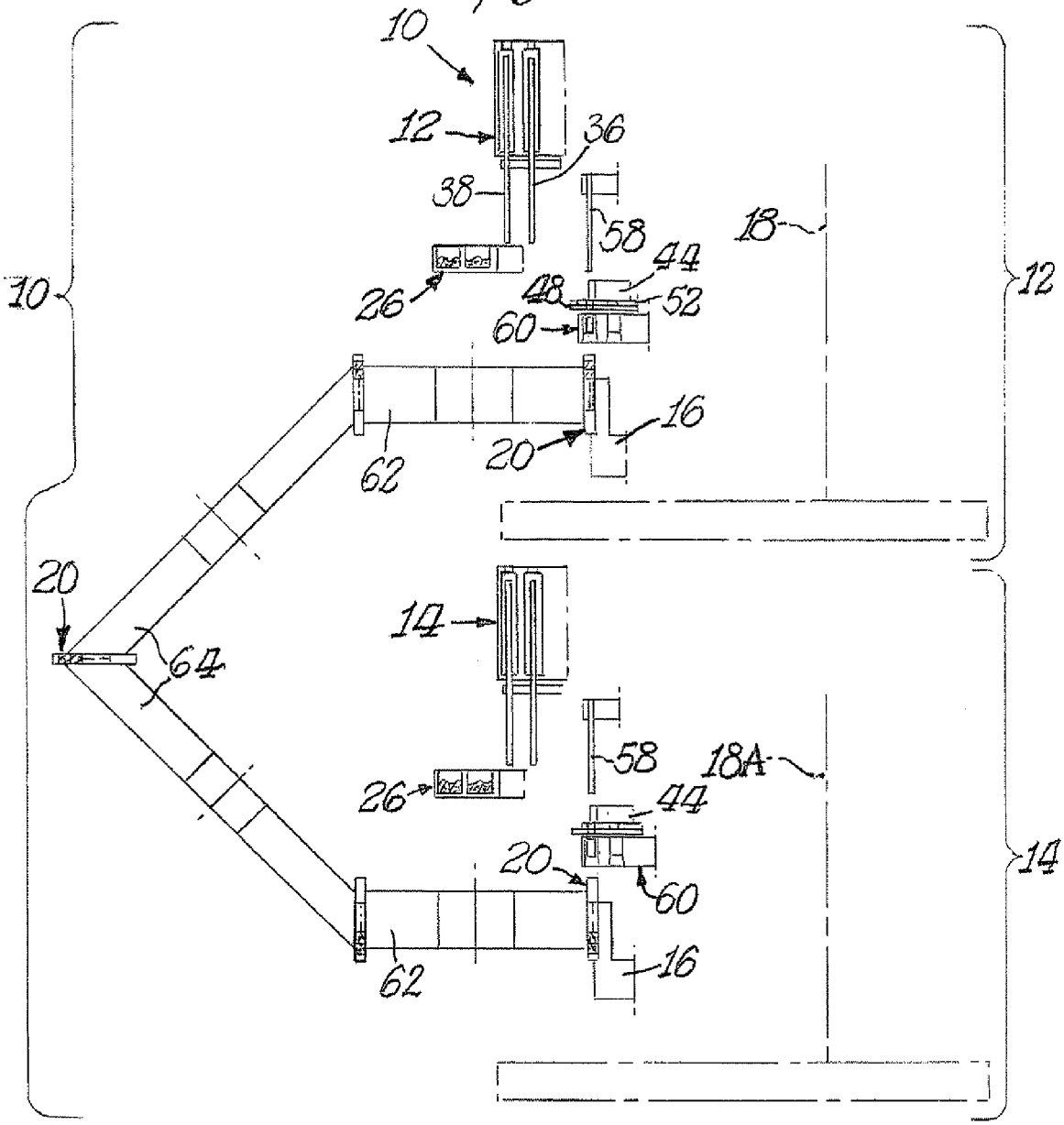
FIG. 20 is a diagrammatic sectional view taken along process plane 17 of FIG. 1 where the filter tube is inverted by a series of bevel and cylindrical transfer drums and transported to a second wheel assembly that repeats the process steps shown in FIGS. 3 through 19 to thereby complete filter tube assembly of the second half of the filter tube.

Referring in more particularity to the drawings, FIG. 1 diagrammatically represents a top view of a vertical filter filling machine 10. Referring now also to FIG. 20, the vertical filter filling machine 10 includes an upper wheel assembly 12 and a lower wheel assembly 14. Essentially the upper wheel assembly functions to fill the upper half of a filter tube with granular material and solid filter segments while the lower wheel assembly 14 fills the lower half of the filter tube with granular material and solid filter segments. The upper and lower wheel assemblies 12, 14 of the vertical filter filling machine 10 of the present invention are substantially identical in design and function and each includes a number of key components.

Figures 2, 3, 4:
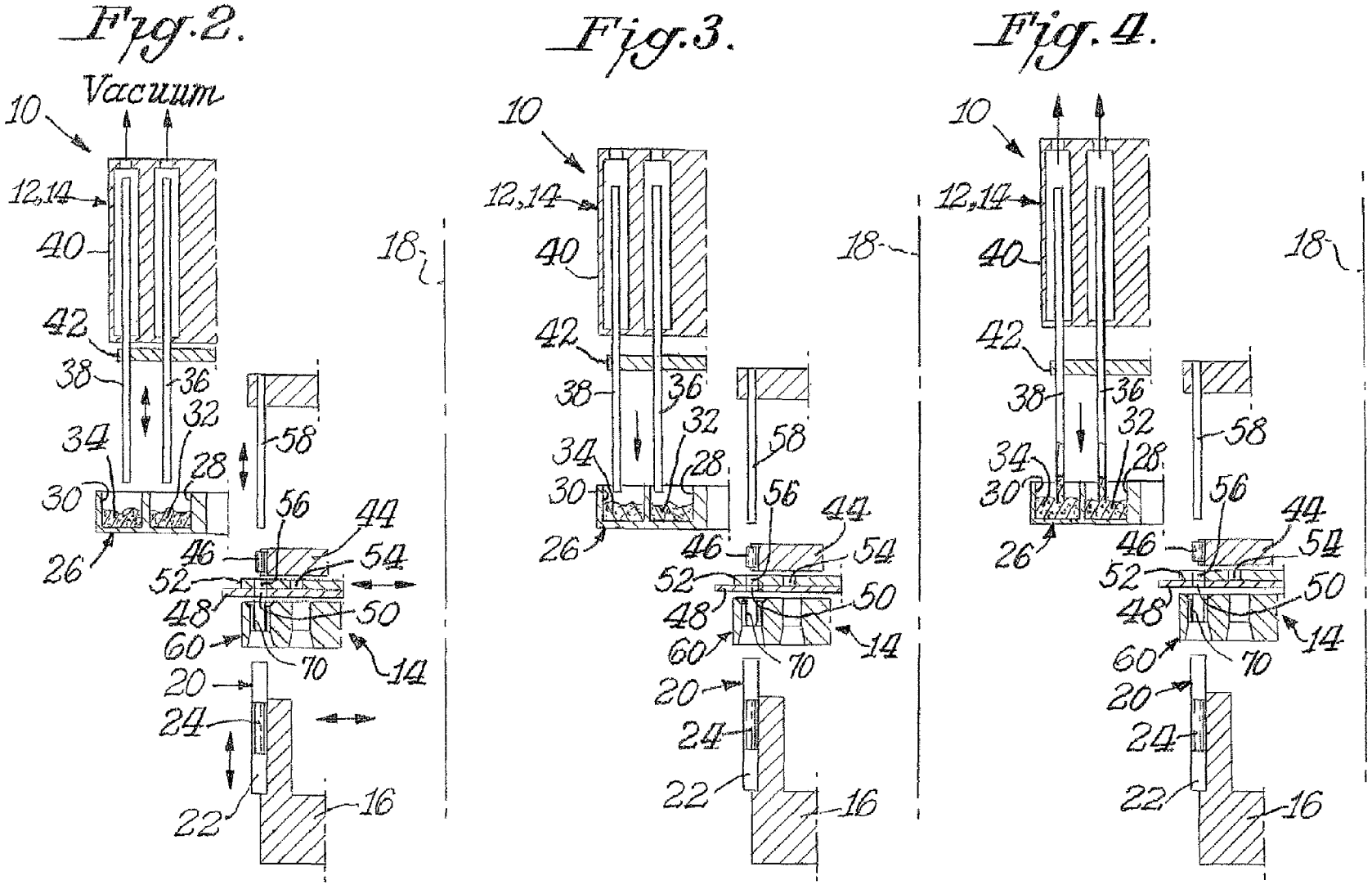
FIG. 2 is a diagrammatic general cross sectional view illustrating the various machine components as well as the direction of movement of each component.
FIG. 3 is a diagrammatic sectional view along the initial process plane 1 of FIG. 1 where fill tubes are moving down into a rotating bin of granular material and wherein filter tubes are loaded into position on a tube flute plate and filter segments are loaded into position on a segment flute plate.
FIG. 4 is a diagrammatic sectional view taken along process plane 2 of FIG. 1 where the fill tubes have moved down into the granular material and vacuum has drawn the granular material into the tubes.

Referring now also to FIG. 2, one of the key components of the machine 10 comprises a tube flute plate 16 that rotates about a central axis 18 of each wheel assemblies 12, 14. The flutes receive an detain filter tubes 20, each of which comprises a hollow cylindrical paper tube 22 with a central solid filter 24 such as a plug of cellulose acetate tow, or filter paper or other material including non-fibrous materials such as plastics. The filter tube when both ends are filled with granular material and solid filter segments forms a two-up dual filter which when combined with wrapped tobacco rods at each end thereof ultimately produces two complete cigarettes. When cut through the middle of the central solid filter, the cigarette filter has a length of approximately 30 mm, but can be shorter or longer, if desired. As explained more fully below, the tube flute plate with the filter tubes secured thereto by vacuum moves in both axial and radial directions during the production of the filter.

Another key component of the vertical filter filling machine 10 comprises a rotating bin 26 of granular material having inner and outer troughs 28, 30 of different granular material 32, 34. The granular bin rotates off center during filter formation so that the bin is outside of several fill tubes 36, 38 which allows these tubes to move axially down for deposit of granular material into the filter tubes 20.

All machine elements that are shown in FIG. 2, except for the granular bin 26, rotate about the axis 18 and are common to each of a plurality of assembly wheel stations. There are fifteen assembly wheel stations in the preferred embodiment. The material bin 26 rotates at a slightly different speed as the other elements, and about a different axis 19 that is off-set from axis 18 so that the material bin 26 and the feed tubes 36 and 38 come into vertical alignment for a portion of their rotation as they rotate during a cycle.

The rotational speeds of the material bin 26 and the feed tubes 36, 38 differ to ensure that the feed tubes 36, 38 pick up material from the material bin 26 at different locations along the material bin 26 from cycle-to-cycle.

The fill tubes 36, 38 together with a vacuum wheel 40 and a fill tube support 42 cooperate with the granular bin 26 for withdrawing and depositing granular material 32, 34 into the upper open end of the vertical filter tubes 20. The vacuum wheel 40 rotates about central axis 18 and functions to supply vacuum to the inner and outer fill tubes 36, 38. The fill tubes 36, 38 rotate with the vacuum wheel 40 about the axis 18, and the fill tubes are attached to the fill tube support 42 for axial movement with the tube support. The internal volume of the fill tubes controls the volume of granular material withdrawn into the tube. Each tube may include an adjustable internal stop for varying the volume by moving the stop closer to or further away from the open end of the tube. The stop is constructed to allow vacuum to pass therethrough, but does not allow the granular material to pass. The stop may comprise an internal, adjustable rod having slight clearance between it and the inner diameter of the fill tube.

An additional key element of the vertical filter filling machine 10 includes a segment flute plate 44 that rotates about the central axis 18. The segment flute plate functions to hold extended length solid filter segments 46 before these segments are cut into two pieces and deposited into the filter tube 20 to seal the granular material in the tubes, as explained more fully below.

Another key element is a first segment plate 48 which also rotates about central axis 18. The first segment plate has a single opening 50 for receiving a first filter segment 51, explained more fully below.

The first segment plate 48 cooperates with a second segment plate 52 which also rotates about the central axis 18. The second segment plate 52 has inner and outer openings 54, 56, and this segment plate moves in a radial direction during filling of the filter tube 20. The outer opening 56 holds a second filter segment 57 while the inner opening allows a plunger 58 to pass there-through when inserting the first filter segment 51 into the filter tube 20. The plunger 58 also rotates about the vertical axis 18 and moves in an axial direction for pushing the solid filter segments 51, 57 into the filter tube 20.

The vertical filter filling machine 10 further includes an alignment plate 60 which also rotates about the vertical central axis 18. The function of the alignment plate is to receive the upper end of the filter tube 20 and thereby align the tube with the segment receiving openings in the first and second segment plates 48, 52. Within the alignment plate is an internal alignment tube or horn 70 which protects the inner walls of the filter tube 20 and maintains the integrity of the tube which is usually made of thin rather flimsy paper. The alignment tube or horn 70 prevents the filter tube 20 from wrinkling and/or buckling during the filling operation.

Preferably, the upper and lower wheel assemblies 12, 14 each include 15 subassemblies and each subassembly includes 12 filter tubes 20 thereby producing 180 half filled filters upon each revolution of the upper wheel assembly. The half-filled filters then transfer to the lower wheel assembly which functions to fill the other half of the filter tube. At production speeds of 30 revolutions per minute approximately 5,400 filters are produced each minute by the machine 10.

As noted above, FIG. 1 diagrammatically illustrates the various process steps in the formation of a filter tube utilizing the vertical filter filling machine 10. The sequence of operation is broken down into 20 process planes specifically illustrated in FIGS. 2-20.

FIG. 3 illustrates process plane 1 where the empty filter tubes 20 each comprising a hollow paper tube 22 with a central solid filter 24 of cellulose acetate are loaded onto the outside flutes of the tube flute plate 16 of machine 10. Suction applied to the flutes of plate 16 hold the filter tubes 20 in vertical position on the outer circumference of the tube flute plate. Additionally, at this particular location, the extended length solid filter segments 46 are transferred onto the segment flute plate 44. The transfer of the filter tubes 20 and filter segments 46 onto the tube flute plate 16 and segment flute plate 44 may be accomplished by external transfer drums (not shown) using known drum technologies.

At the next plane of operation shown in FIG. 4 the fill tubes 36, 38 are moved downwardly into the granular materials 32, 34 within the troughs 28, 30 of the rotating off-center granular material bin 26. Vacuum from the vacuum wheel 40 withdraws a predetermined amount of material 32 into inner fill tube 36 while a predetermined amount of material 34 is drawn into the outer fill tube 38. As an alternative to granular material, gels may be placed in one or both of the troughs 28, 30, and the fill tubes may be arranged to withdraw predetermined amounts of such gels. Also, premeasured capsules of gels and other material may be individually positioned in the fill tube for subsequent deposit into the filter tube.

Figure 5:
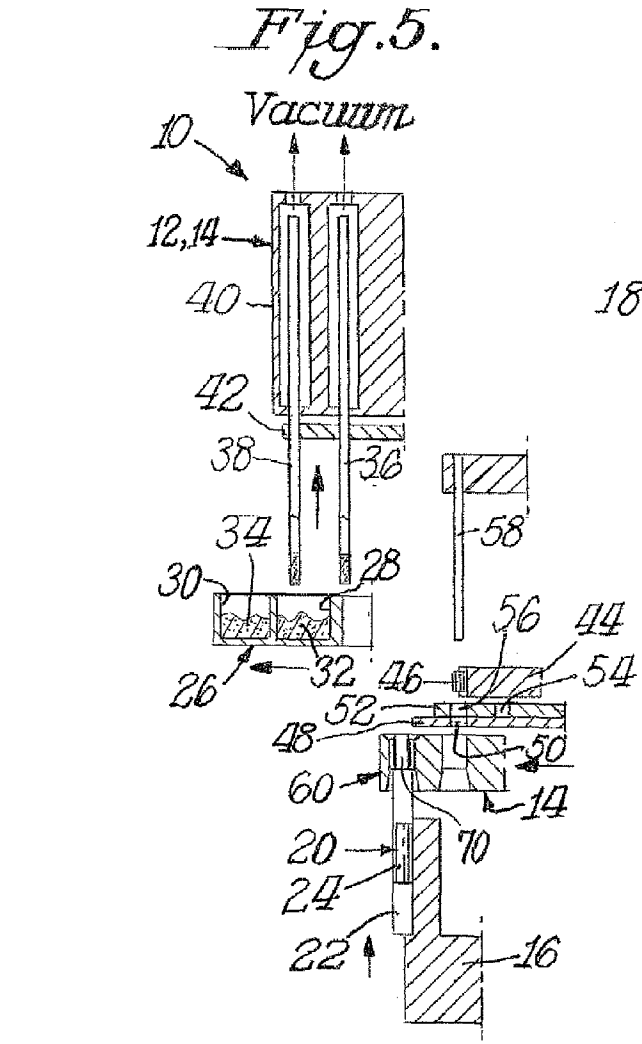
FIG. 5 is a diagrammatic sectional view taken along process plane 3 of FIG. 1 where the fill tubes loaded with granular material have moved up, the tube flute plate is moving upwardly to position the filter tubes in an alignment plate and the tube flute plate and alignment plate are moving radially out.

FIG. 5 illustrates the next sequence in the operation of the vertical filter filling machine 10. Here, the fill tubes 36, 38, with loaded granular materials therein have moved in an upward direction so that both tubes clear the top of the bin 26. At the same time the tube flute plate 16 is moving in an upward direction so that the filter tube 20 enters and is aligned by the alignment plate 60 and the internal alignment tube 70. Simultaneous with the upward movement of the filter tube into the alignment plate, both the alignment plate and the tube flute plate move outwardly in a radial direction.

Figure 6:
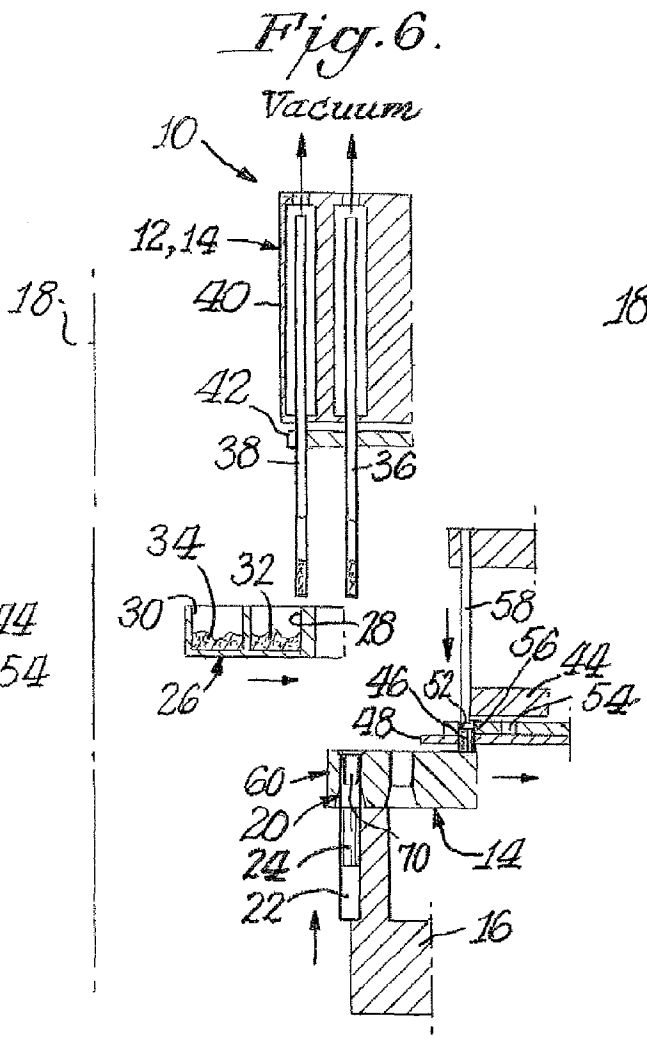
FIG. 6 is a diagrammatic sectional view taken along process plane 4 of FIG. 1 where the tube flute plate has moved up to its stop position and completely inserted the filter tube into the alignment plate and over an internal alignment tube; the tube flute plate, filler tube and alignment plate have moved radially out to a stop position which positions the filter tube in vertical alignment with the inner fill tube; and the plunger has pushed the filter segment through the second segment plate into the first segment plate and into contact with the surface of the alignment plate.

FIG. 6 illustrates the next step in the sequence of operation of the vertical filter filling machine 10. At this position the tube flute plate 16 has moved up to its uppermost stop position and the filter tube 20 is completely inserted into the filter tube opening in the alignment plate 60 and around the internal alignment tube or horn 70. The tube flute plate 16, filter tube 20 and alignment plate 60 have now moved radially out to a stop position which places the open end of the filter tube 20 in vertical alignment with the inner fill tube 36. Simultaneous with such movement the plunger 58 pushes the extended length filter segment 46 into and through the outer opening 56 in the second segment plate 52 and into the opening 50 in the first segment plate 48 until the filter segment engages the surface of the alignment plate 60.

Figure 7:
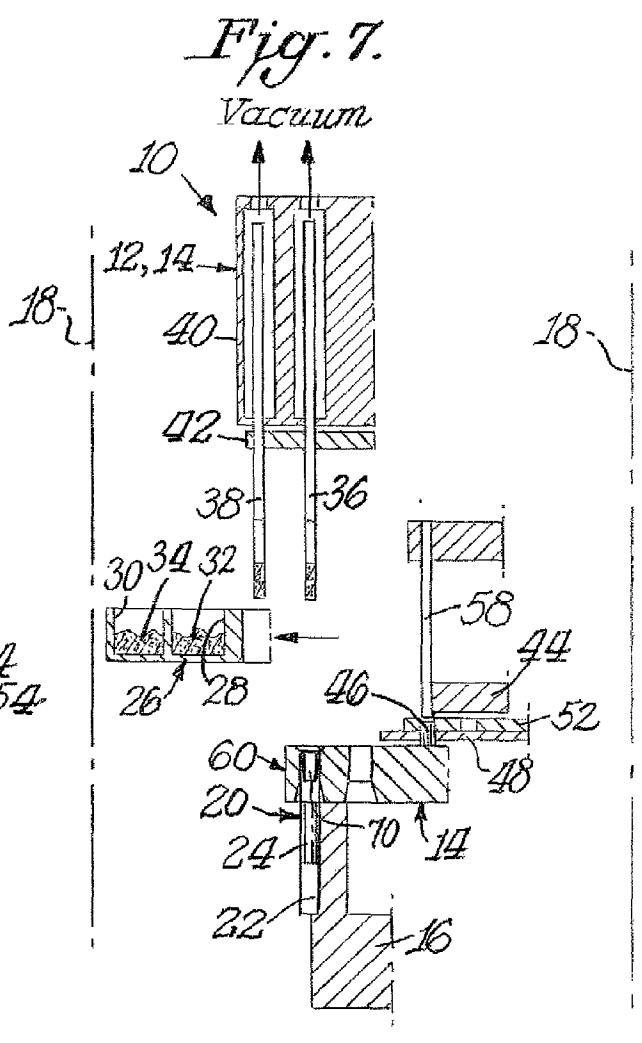
FIG. 7 is a diagrammatic sectional view taken along process plane 5 of FIG. 1 where the internal vacuum on the segment flute plate is turned off, the plunger is moving up out of contact with the filter segment, and the rotating off-center granular bin is out beyond the vertical path of the fill tubes and fill tube support.

FIG. 7 shows the next step in the sequence where the internal vacuum on the segment flute plate 44 is terminated and the plunger 58 moves up and out of contact with the filter segment 46. Also, due to the off-center axis of the rotating bin 26, the cross-section of the bin at this location is out beyond the vertical path of the fill tubes 36, 38 and the fill tube support 42. At the next step in the sequence shown in FIG. 8 the extended length filter segment 46 is cut into two pieces by a rotary knife 66 which enters between the first and second segment plates 48, 52.

Figures 8, 9, 10:
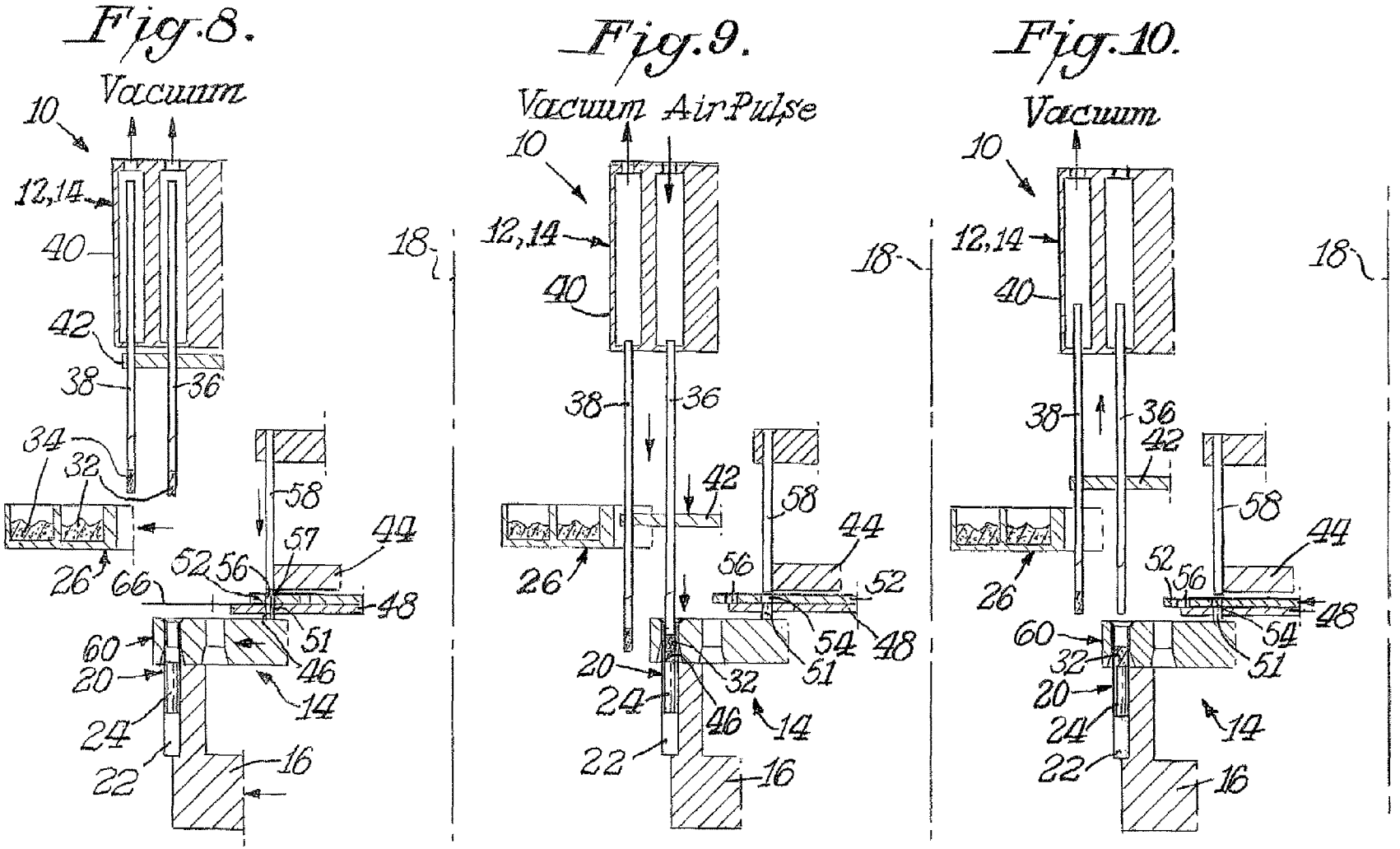
FIG. 8 is a diagrammatic sectional view taken along process plane 6 of FIG. 1 where the filter segment is cut into two pieces.
FIG. 9 is a diagrammatic sectional view taken along process plane 7 of FIG. 1 where the fill tubes have moved axially down and the inner tube is inside the filter tube for deposit of the granular material into the filter tube, and the second segment plate with the upper cut portion of the filter segment moves radially out until the inner hole thereof is in alignment with the plunger and the lower cut portion of the filter segment in the first segment plate.
FIG. 10 is a diagrammatic sectional view taken along process plane 8 of FIG. 1 where the fill tubes move up until they clear the upper surface of the alignment plate.

FIG. 9 shows the next process step at plane 7 of FIG. 1. Here the fill tubes 36, 38 have moved axially down and the inner fill tube 36 is inside the upper hollow end of the filter tube 20. Vacuum wheel 40 which holds the granular material 32 in the inner fill tube has been turned off and the granular material 32 flows into the filter tube. Positive air pressure can be used to increase granular flow from the inner fill tube 36. Also, the second segment plate 52 with the upper cut portion of the filter segment 46 moves radially out until the inner opening 54 of the second segment plate 52 is in line with the plunger 58 and the lower cut portion of the filter segment 51 in opening 50 of the first segment plate 48.

In the next sequence of operation shown in FIG. 10, the fill tubes 36, 38 move in an upward direction until both tubes clear the upper surface of the alignment plate 60.

Figures 11, 12, 13:
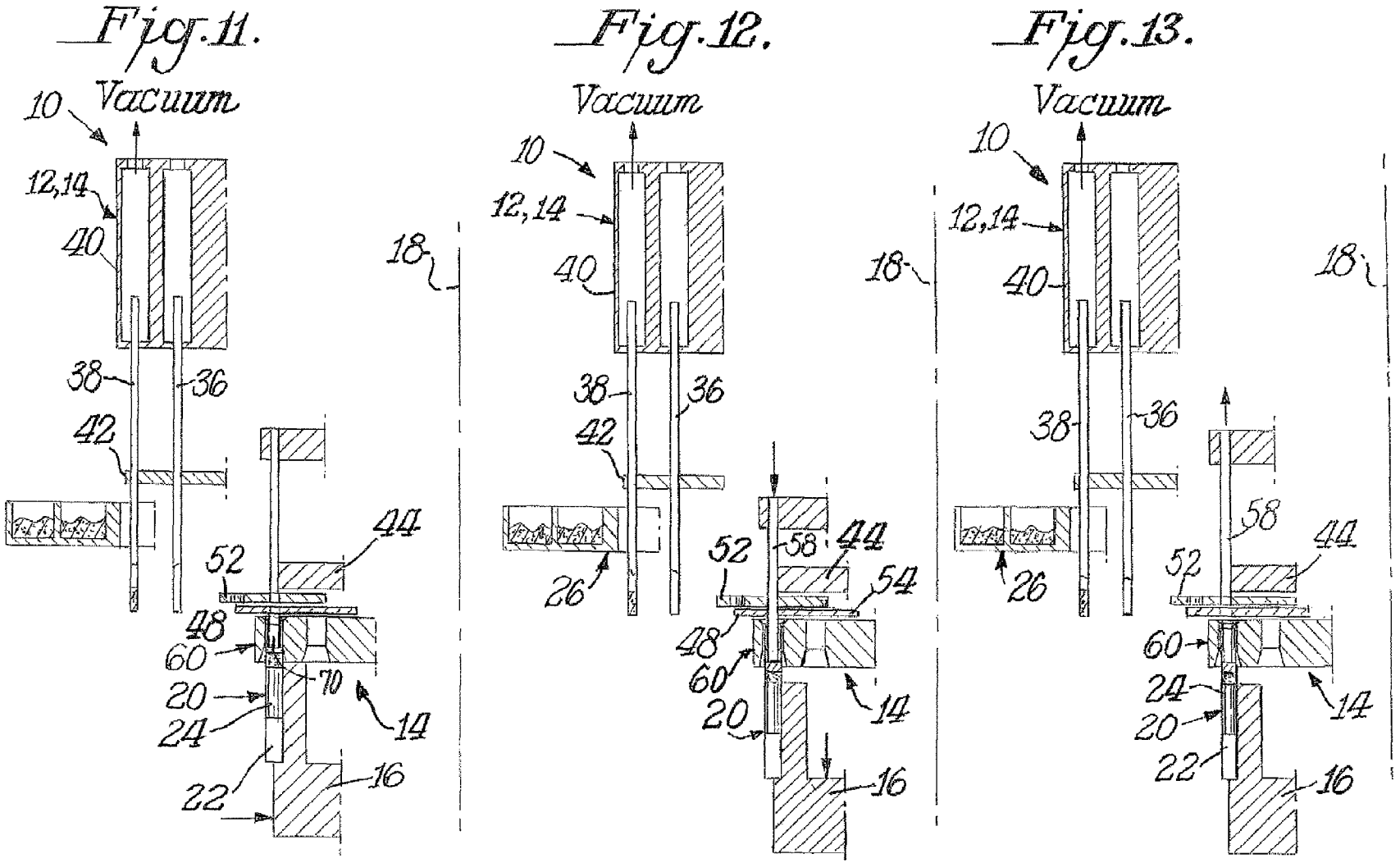
FIG. 11 is a diagrammatic sectional view taken along process plane 9 of FIG. 1 where the filter tube, alignment plate and tube flute plate have moved radially to a stop position where the filter tube is in alignment with the plunger and lower cut filter segment portion in the first segment plate.
FIG. 12 is a diagrammatic sectional view taken along process plane 10 of FIG. 1 where the plunger moves down to thereby push the lower portion of the cut filter segment into the filter tube against the granular material therein.
FIG. 13 is a diagrammatic sectional view taken along process plane 11 of FIG. 1 where the plunger moves axially up to clear the second segment plate.

FIG. 11 illustrates the next step in the sequence where the filter tube 20, alignment plate 60, and tube flute plate 16 move radially in to a stop position where the filter tube 20 is in line with the plunger 58 and the lower cut filter segment portion 51 in the first segment plate 48.

In the next sequence shown in FIG. 12 the plunger 58 moves in a downward direction and pushes the first filter segment 51 into the filter tube 20 against the granular material 32. The filter segment 51 is slightly compressed as it moves through the internal alignment tube 70, and when it exits the alignment tube it expands slightly into engagement with the side walls of the filter tube. At this point, the tube flute plate 16 may move in a downward direction at the same speed as the first filter segment. This operation maintains the integrity of the filler tube by eliminating any significant relative frictional movement between the filter segment 51 and the interior side walls of the filter tube 20. The plunger 58 then moves axially up to clear the second segment plate 52 as shown in FIG. 13.

Figures 14, 15, 16:
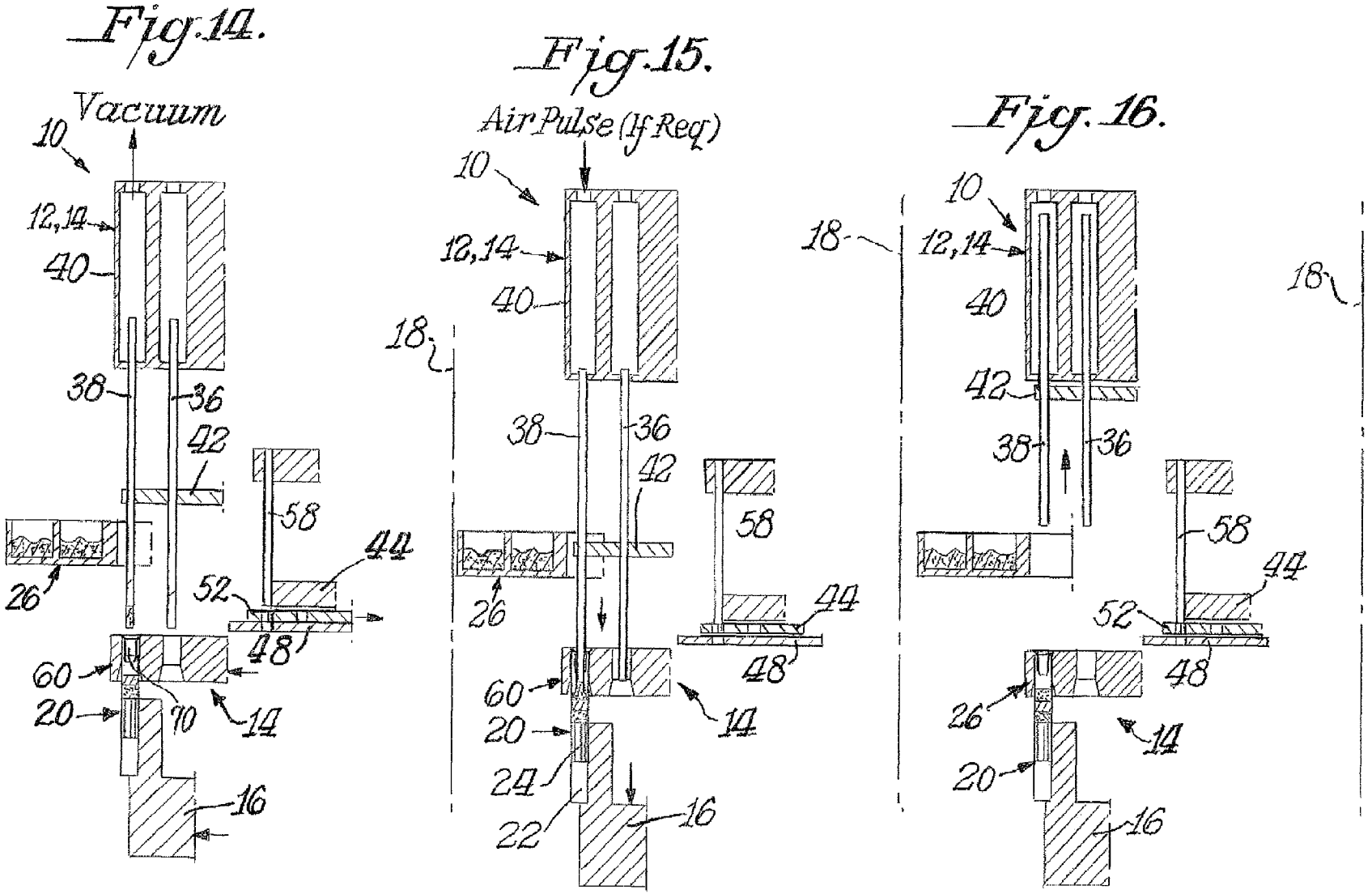
FIG. 14 is a diagrammatic sectional view taken along process plane 12 of FIG. 1 where the filter tube, tube flute plate and alignment plate have moved radially out to a position where the filler tube is in alignment with the outer fill tube, and the second segment plate with the upper cut portion of the filter segment moves radially in until the cut filter segment is in alignment with the plunger.
FIG. 15 is a diagrammatic sectional view taken along process plane 13 of FIG. 1 where the fill tubes have moved axially down to thereby position the outer fill tube inside the filter tube for deposit of the granular material into the filter tube.
FIG. 16 is a diagrammatic sectional view taken along process plane 14 of FIG. 1 where the fill tubes move up and return to their home positions.

Next, as shown in FIG. 14, the filter tube 20, tube flute plate 16 and alignment plate 60 have moved radially out to a stop position where the filter tube 20 is in line with the outer fill tube 38. The second segment plate 52 with the second filter segment 57 then moves radially in until the second filter segment 57 is in line with the plunger 58.

At the next location illustrated in FIG. 15 the fill tubes 36, 38 have moved axially down and the outer fill tube 38 is inside the upper hollow end of the filter tube 20. Vacuum from vacuum wheel 40 holding the granular material 34 in the outer fill tube 38 is then turned off and the granular material 34 flows into the filter tube 20. Here again, positive air pressure may be used to increase the flow of granular material from the outer fill tube 38 into the upper hollow end of the filter tube. Next, the fill tubes 36, 38 move up and return to their home position as shown in FIG. 16.

Figures 17, 18, 19:
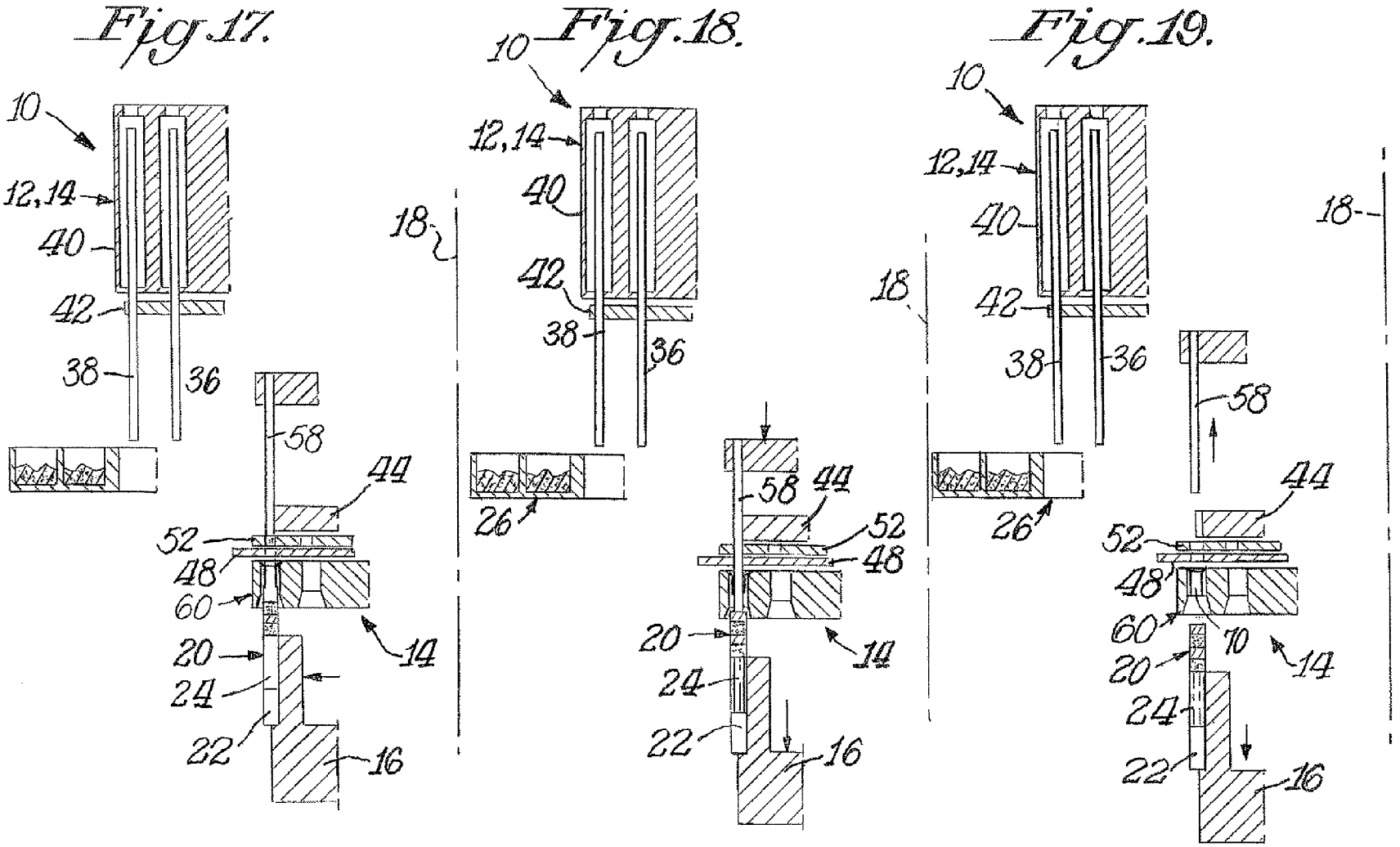
FIG. 17 is a diagrammatic sectional view taken along process plane 15 of FIG. 1 where the filter tube, alignment plate and tube flute plate move radially to a position to thereby position the filter tube in alignment with the plunger and the upper cut filter segment portion in the second segment plate.
FIG. 18 is a diagrammatic sectional view taken along process plane 16 of FIG. 1 where the plunger moves down to thereby push the upper portion of the cut filter segment through the first segment plate and into the filter tube against the granular material therein.
FIG. 19 is a diagrammatic sectional view taken along process plane 17 of FIG. 1 where the tube flute plate and filter tube move axially down to their home position while the plunger retracts to its home position.

FIG. 17 shows the next step in the sequence of operation where the filter tube 20, alignment plate 60 and tube flute plate 16 move radially in to a stop position where the filter tube is in alignment with the plunger 58 and the second filter segment 57 in the second segment plate 52. The plunger 58 then moves down and pushes the second filter segment 57 through the opening 50 in first segment plate 48 and into the filter tube 20 against the granular material 34. This particular step is shown in FIG. 18.

The filling of the upper half of the filter tube is now complete and at the next station the tube flute plate 16 and filter tube move axially down to the home position of the tube flute plate. Simultaneous therewith the plunger 58 retracts to its home position and internal vacuum on the tube flute plate is turned off which allows the filter tube to be removed from the upper wheel assembly 12 and transferred to the lower wheel assembly 14 for filling of the other end of the filter tube.

FIG. 20 illustrates plane 17 of FIG. 1 where the filter tube 20 has been filled on one end and the filter tube has returned to its home position. In order to fill the opposite end of the filter tube a series of cylindrical and bevel transfer drums 62, 64 can be used to remove the filter tube from the upper (first) wheel assembly 12, flip it end for end and deposit the filter tube on the lower (or second) wheel assembly 14 which simply repeats the above steps shown in FIGS. 3-19. After traveling around second wheel assembly 14 the finished filter tube with both ends filled is removed from the vertical filter filling machine 10 for testing and storage. The second wheel assembly could be arranged to the side of the first wheel assembly 12, instead of below it, if desired.

In the preferred embodiment, each complete assembly wheel 12, 14 comprises 15 wheel assembly stations each with an arcuate extent of 24 degrees and centered about axis 18. Other embodiments may be constructed with different numbers of assembly wheel stations and different numbers of fill tubes, flutes and holes at each wheel assembly station.

Preferably, each wheel assembly 12, 14 includes a tube flute plate 16 which in the preferred embodiment has twelve (12) flutes along its arcuate perimeter. A same number of flutes are provided along the arcuate perimeter of the segment flute plate 44. Each wheel assembly further includes twelve (12) alignment tubes 70, twelve (12) fill tubes 38, twelve (12) fill tubes 36 and twelve (12) plungers 58. Holes in first and second segment plates 48 and 52, through which the filling materials pass, are through which the filling materials pass are also twelve (12)-count each for each assembly wheel station.

Each wheel assembly station includes twelve fill tubes 36 and 38, which for a given wheel assembly station are all supported by an independent slide system that is driven by an internal cam and lever system which imparts a predescribed axial (up and down) motion of the full tubes 36 and 38 as the wheel assembly is rotated through a complete cycle. Preferably, the fill tubes 36 and 38 do not move radially during a cycle.

Likewise, each wheel assembly station includes 12 plungers 58 that are similarly supported and controlled to execute their prescribed up and down motion per cycle.

Each wheel assembly station 12, 14 includes a second segment plate 52 which has an independent slide system that is driven by an internal cam which imparts a predescribed radial motion (in and out) as the respective wheel assembly is rotated through a complete cycle.

Preferably, the first segment plate 48 rotates about axis 18 without either radial or axial motion.

The tube flute plate 16 of each wheel assembly station is on an independent slide system and driven by a cam and lever to impart the prescribed axial motion (up and down) for the tube plate 16 as the respective assembly wheel station rotates through a complete cycle. The axial motion slide of the tube flute plate 16 and the alignment plate 60 are mounted on an independent slide system that is driven by an internal cam which imparts a predescribed concurrent radial motion (in and out) of tube flute plate 16 and the alignment plate 60 as the wheel assembly is rotated through a complete cycle.

Figure 21:
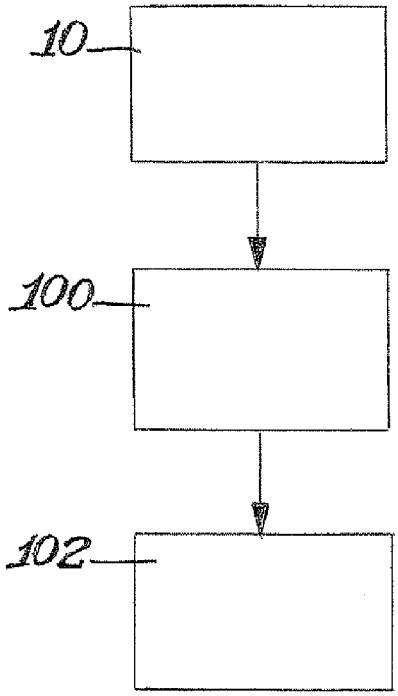
FIG. 21 is a simple diagrammatic view illustrating the concept of cigarette assembly immediately downstream from the vertical filing machine without the need for storing the filters.

As an alternative to filter storage, a tipping machine may be positioned to receive the finished filters as they are removed from the vertical fill machine 10. Wrapped tobacco rods are positioned at both ends of the finished filter and tipping paper is used to secure the rods to the filter. Cutting the filter in half produces two complete cigarettes. FIG. 21 illustrates an arrangement that includes a vertical fill machine 10 for producing multiple cavity dual filters, as explained above, and reference character 100 identifies a conventional tipping machine well known in the tobacco industry for taking dual filters and securing wrapped tobacco rods at the opposite ends of the filter with tipping paper. The thus formed tobacco/filter assembly is then cut in half at the central solid filter 24 at station 102 to produce two cigarettes each having a multiple cavity filter and a wrapped tobacco rod. U.S. Pat. No. 5,135,008 and published applications U.S. 2003/0131856 A1 and U.S. 2005/094014 A1 illustrate and describe tipping machines and these documents are incorporated herein by reference in their entirety for all useful purposes.

FIGS. 22-26 illustrate another vertical filter filling machine 10A similar in many respects to machine 10 except for a modified plunger 58A. Otherwise, machines 10 and 10A are similar and both function to produce multiple cavity dual filters.

As described above, FIGS. 1-19 show the various movements that take place at each assembly station during rotation of the upper and lower assembly wheels 12, 14 and the filling of the filter tubes 20. As the assembly starts rotating from the position of FIG. 11 to the position of FIG. 12, the plungers 58 force the first solid filter segments 51 against the first granular materials 32. FIGS. 22-25 are similar sectional views showing the various movements of the modified plunger 58A of machine 10A and the operation of a compression spring 200 associated with each plunger.

The upper end of plunger 58A is secured to a plunger support plate 202 between an upper plunger stop bracket 204 and a lower plunger guide bracket 206. The plunger 58A includes a collar 208 secured thereto, and the compression spring 200 extends between the plunger stop bracket 204 and the collar 206 urging the plunger in a downward direction. The arrangement is such that the vertical movement of the plunger 58A relative to the plunger support plate 202 is limited to the distance 210.

In order for a multiple filled cavity filter to function properly, it is important that each granular dose be packed tightly, and that each solid filter segment be tight against the granular dose. The compression spring 200 of each plunger 58A functions to ensure that the solid filter segments 51, 57 and the granular materials 32, 34 are tightly packed.

Figure 22:
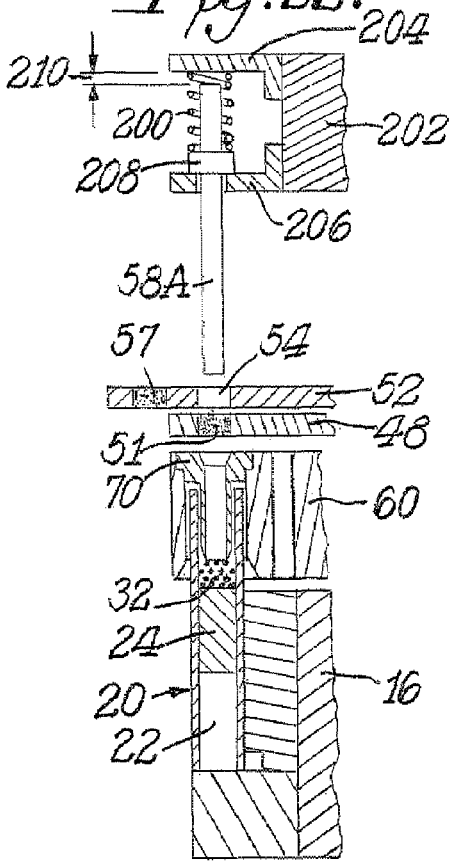
FIG. 22 is a diagrammatic sectional view similar to FIG. 11, but illustrating a modified plunger with a compression spring.
Figure 23:
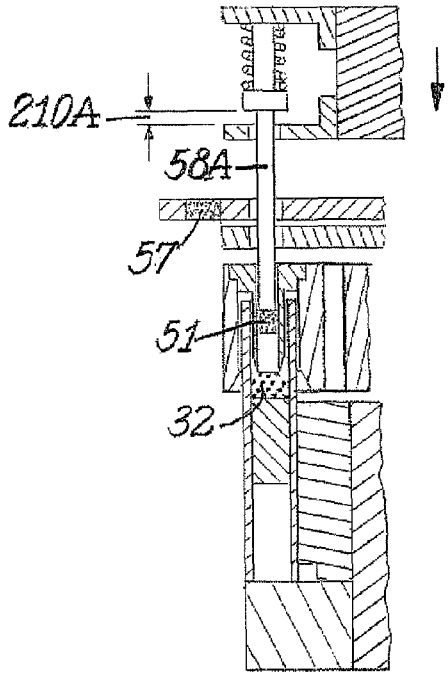
FIG. 23 is a diagrammatic sectional view similar to FIG. 23 illustrating initial downward movement of the modified plunger.

After the filter tube 20 has received the first granular material 32 and the second segment plate 52 has moved the second segment 57 to the left, the plunger 58A is ready to force the first filter segment 51 into the filter tube. These positions are shown in FIG. 22, and its should be noted that the compression spring 200 has forced the plunger collar into contact with the plunger guide bracket 206 and that a gap 210 exists between the upper end of the plunger 58A and the plunger stop bracket 204. As the plunger support plate 202 moves in a downward direction as shown in FIG. 23, the plunger 58A forces the first solid filter segment 51 out of the first segment plate 48 and into the alignment tube or horn 70. Since the first solid filter segment 51 is forced through the alignment tube, the compression spring 200 contracts until the top surface of the plunger contacts the plunger stop bracket 204. A gap 210A now exists between the collar 208 and the plunger guide bracket 206.

Figure 24:
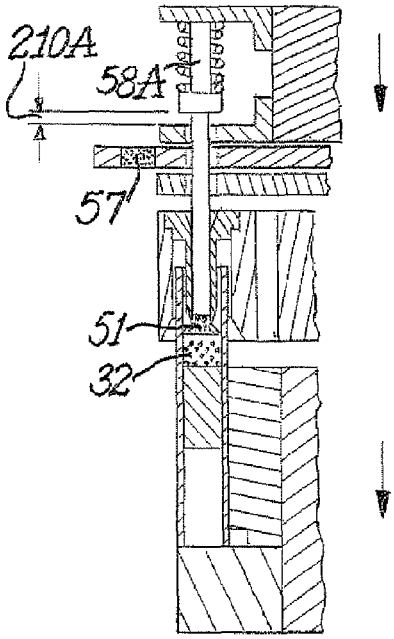
FIG. 24 is a diagrammatic view similar to FIGS. 22 and 23 illustrating the lowermost downward position of the plunger support plate but with a gap between the initial deposit of granular material and the first filter segment as it emerges from the alignment tube.

As the plunger support plate 202 continues its downward movement shown in FIG. 24, the solid contact between the upper end of the plunger 58A and the plunger stop bracket 204 forces the first solid filter segment 51 to slide down the inner surface of the alignment tube 70. Moreover, as the leading edge of the segment 51 reaches the top of the granular material 32, the tube flute plate 16 and the filter tube 20 thereon move down at a speed that matches the downward speed of the solid filter segment 51. This matched motion is shown in FIG. 24 and it prevents excessive sliding of the segment 51 inside the filter tube 20. The possibility of wrinkling and/or buckling of the filter tube is substantially reduced thereby maintaining the integrity of the tube.

Figure 25:
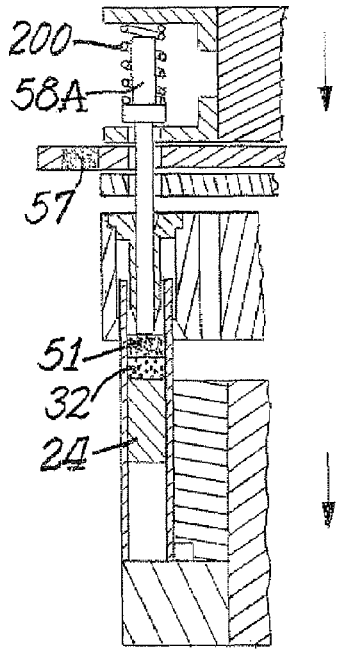
FIG. 25 is a diagrammatic view similar to FIG. 24 but with the compression spring of the plunger extended and thereby pushing the first filter segment firmly against the initial deposit of granular material.

As shown in FIG. 24, the filter segment 51 is partially out of the alignment tube 70 and is beginning to expand inside the filter tube 20. The gap 210A still exists because high force is still required to push the segment 51 through the alignment tube 70. Also, due to the accuracy of the amount of granular material 32 and the cut length of the filter segment 51, a possible gap could exist between the granular material and the solid filter segment 51. As the upper end of the segment 51 reaches the end of the alignment tube 70, the friction between the segment and the side walls of the alignment tube decreases and the compression spring begins to extend thereby forcing the segment 51 to pack tightly against the granular material 32, as shown in FIG. 25, so as to create a fully filled condition within the filter tube. Once the segment 51 is packed tightly against the granular material 32, a small gap may exist between the plunger collar 208 and the plunger guide bracket 206, depending upon the accuracy of the amount of granular material and the cut length of the filter segment 51.

Figure 26:
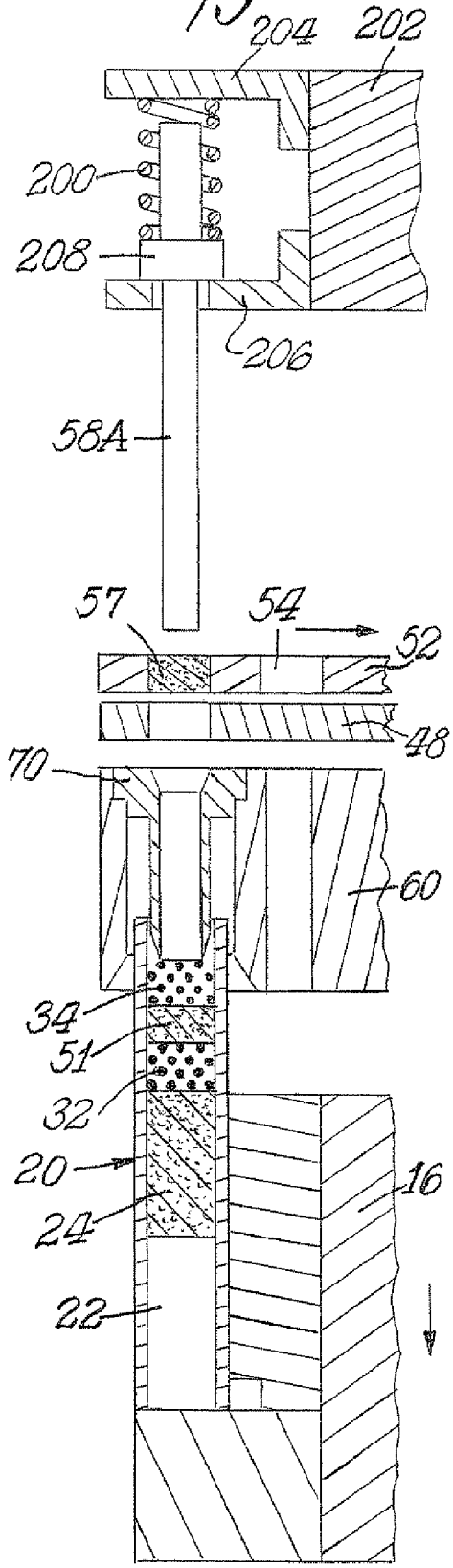
FIG. 26 is an enlarged diagrammatic sectional view similar to FIG. 17 but illustrating the modified plunger with the compression spring.

A similar sequence of movement occurs when the second granular material 34 and the second solid filter segment 57 are deposited in the filter tube 20. FIG. 26 shows the second filter segment 57 ready for insertion into the filter tube. Also, the same sequences occur after the filter tube is inverted and the other half is filled with granular materials 32, 34 and solid filter segments 51, 57.

It should be understood that the above detailed description while indicating preferred embodiments of the invention are given by way of illustration only since various changes and modifications within the spirit and scope of the invention will become apparent to those skilled in the art from the detailed description. For example, an alternative embodiment may comprise a linear and/or endless belt configuration that is arranged to execute assembly steps that are equivalent to those of the rotary configuration of the preferred embodiment.

What is claimed is:

1. Apparatus for producing compound cigarette filters comprising:

a rotating tube flute plate for holding and transporting a plurality of filter tubes along a circular path, each filter tube having hollow ends and a solid filter center, with the tubes in vertical orientation;

a rotating bin of a first material;

a plurality of vertically oriented rotating fill tubes with suction applied thereto for withdrawing predetermined amounts of the first material from the rotating bin and depositing one predetermined amount into an upper open end of each filter tube directly against the solid filter center upon termination of the suction;

a rotating filter segment plate for holding a plurality of solid filter segments; and a plurality rotating plungers for vertically pushing the solid filter segments out of the filter segment plate into the upper open ends of the filter tubes with one solid filter segment directly against the first material in each filter tube to thereby seal the material in the tube.

2. Apparatus for producing compound cigarette filters as in claim 1 further comprising:

a plurality of hollow open ended alignment tubes, one within each filter tube for guiding the materials and filter segments into the filter tubes while maintaining the integrity of the filter tubes.

3. Apparatus as in claim 1 wherein the first material is granular.

4. Apparatus as in claim 1 for producing compound cigarette filters further comprising:

a second plurality of vertically oriented rotating fill tubes with suction applied thereto for withdrawing predetermined amounts of a second material from the rotating bin and depositing one predetermined amount of the second material into the open upper end of each filter tube directly against the solid filter segment upon termination of the suction;

a rotating second filter segment plate for holding a plurality of second solid filter segments; and wherein the plurality of rotating plungers vertically push the second solid filter segments out of the second filter segment plate into the upper open ends of the filter tubes with one second filter segment directly against the second material in each filter tube to thereby seal the second material in the tube.

5. Apparatus for producing compound cigarette filters as in claim 4 further comprising:

a plurality of hollow open ended alignment tubes, one within each filter tube for guiding the materials and filter segments into the filter tubes while maintaining the integrity of the filter tubes.

6. Apparatus as in claim 4 wherein the first and second materials are granular.

7. Apparatus for producing compound cigarette filters as in claim 4 wherein the rotating bin includes two compartments, one for each of the first and second materials.

8. Apparatus for producing compound cigarette filters as in claim 4 further comprising:

a segment flute plate for holding a plurality of extended length solid filter segments; and a rotating cutter moveable between the solid segment plate and the second solid segment plate for cutting the extended length solid filter segment after positioning thereof in the solid segment plate and second solid segment plate to thereby form the solid filter segments and the second solid filter segments.

9. Apparatus for producing compound cigarette filters as in claim 4 wherein the rotating tube flute plate, the rotating bin of material, the plurality of vertically oriented fill tubes and second fill tubes, the rotating filter segment plate and second filter segment plate, and the plurality of rotating plungers collectively comprise an upper wheel assembly rotating about a central vertical axis;

a substantially identical lower wheel assembly also rotating about the central vertical axis;

means for removing half filled filter tubes from the upper wheel assembly, inverting the filter tubes and placing them on the rotating tube flute plate of the lower wheel assembly; and whereby the other ends of the filter tubes are filled with material and solid filter segments on the lower wheel assembly.

10. Apparatus for producing compound cigarette filters as in claim 4 wherein the solid filter center of each filter tube and the solid filter segments and second solid filter segments comprise cellulose acetate tow.

11. Apparatus for producing compound cigarette filters as in 10 in combination with a tipping machine immediately downstream therefrom constructed and arranged to combine wrapped tobacco rods, one at each end of each finish filter, and a cutter for severing each filter at its midpoint to form two complete cigarettes.

12. Apparatus for producing compound cigarette as in claim 4 wherein each of the plungers is spring biased and arranged to insure that the solid filter segments are solidly positioned against the first and second materials so as to create a fully filled condition within the filter tube.

* * * * *